US009334088B2

(12) United States Patent
Robinson et al.

(10) Patent No.: US 9,334,088 B2
(45) Date of Patent: May 10, 2016

(54) MULTI-COMPONENT DISPENSER

(75) Inventors: Spencer Robinson, Bury (GB); Paul Devonport, Burton Joyce (GB); Neil David Burdett, Sutton In Ashfield (GB); Alistair Jerome Richard Little, Belper (GB); Robert Ian Paterson, London (GB)

(73) Assignee: 2K POLYMER SYSTEMS LIMITED (GB)

( * ) Notice: Subject to any disclaimer, the term of this patent is extended or adjusted under 35 U.S.C. 154(b) by 66 days.

(21) Appl. No.: 13/811,086

(22) PCT Filed: Jun. 22, 2011

(86) PCT No.: PCT/GB2011/051167
§ 371 (c)(1), (2), (4) Date: Mar. 29, 2013

(87) PCT Pub. No.: WO2012/010859
PCT Pub. Date: Jan. 26, 2012

(65) Prior Publication Data

US 2013/0193163 A1 Aug. 1, 2013

(30) Foreign Application Priority Data

Jul. 19, 2010 (GB) ..... 1012094.7
Dec. 7, 2010 (GB) ..... 1020763.7

(51) Int. Cl.
*B65D 83/00* (2006.01)
*B65D 35/44* (2006.01)

(Continued)

(52) U.S. Cl.
CPC ..... *B65D 35/44* (2013.01); *B05C 17/00513* (2013.01); *B05C 17/00553* (2013.01);

(Continued)

(58) Field of Classification Search
CPC ..... B05C 17/00556; B65D 81/3244; B65D 81/3233; B65D 83/0072
USPC ..... 222/94, 494
See application file for complete search history.

(56) References Cited

U.S. PATENT DOCUMENTS 4,838,457 A * 6/1989 Swahl et al. ..... 222/48
5,137,178 A * 8/1992 Stokes et al. ..... 222/94

(Continued)

FOREIGN PATENT DOCUMENTS

EP 0541972 A1 10/1992
EP 1010643 11/1999
WO 0144074 A1 6/2001

*Primary Examiner* — Daniel R Shearer
(74) *Attorney, Agent, or Firm* — Bacon & Thomas, PLLC

(57) ABSTRACT

A dispensing device for a multi-component composition comprises a plurality of collapsible bag compartments (109, 110) located within a housing (101). The compartments extend adjacent each other and have cross-sectional areas that are proportional to an intended volume mixing ratio for the multi-component composition. Each compartment has an opening (123) that communicates with a device outlet at one end of the housing, and an opposite, sealed end that is exposed to pressure from a compression device (103). The compression device acts to collapse the compartments and dispenses the components through the device outlet. The components have different viscosities. The chamber of a less viscous component has a flow control regulator (111) to compensate for extra pressure exerted on that compartment by an adjacent compartment containing a more viscous component. The flow control regulator restricts the flow of the less viscous component, thereby achieving a volume mixing ratio that is closer to the intended volume mixing ratio.

14 Claims, 4 Drawing Sheets

(51) Int. Cl.
*B65D 81/32* (2006.01)
*B05C 17/005* (2006.01)

(52) U.S. Cl.
CPC ..... *B65D81/325* (2013.01); *B65D 81/3261* (2013.01); *B65D 83/0072* (2013.01); *B05C 17/00556* (2013.01); *B65D 81/3233* (2013.01); *B65D 81/3244* (2013.01); *Y10T 29/4984* (2015.01)

(56) References Cited

U.S. PATENT DOCUMENTS 5,228,599 A * 7/1993 Keller ..... B05C 17/00513 222/137
5,332,122 A 7/1994 Herold et al.
5,443,183 A * 8/1995 Jacobsen ..... B05C 17/00513 222/137
5,593,065 A * 1/1997 Harrold ..... 222/94
5,593,066 A 1/1997 Konuma et al.
6,161,729 A * 12/2000 Gentile et al. ..... 222/94
6,308,862 B1 * 10/2001 Fillmore ..... B05B 11/0043 222/105
6,889,870 B2 * 5/2005 De Laforcade ..... 222/1
7,617,950 B2 * 11/2009 Norris ..... B65D 35/242 222/1
2003/0051610 A1 * 3/2003 Dux et al. ..... 99/495
2006/0144854 A1 7/2006 Clemens et al.
2009/0266843 A1 * 10/2009 Griesbaum ..... B05C 17/00559 222/137
2010/0108709 A1 5/2010 Frey

* cited by examiner

MULTI-COMPONENT DISPENSER

The present specification relates to a dispensing device for dispensing inter-reactive, multi-component compositions.

Dispensing devices for dispensing inter-reactive, multi-component compositions are already available and come in various forms. The components need to be kept separate until they are dispensed for use. The present invention is particularly concerned with dispensing devices where the components are housed within collapsible bag compartments, for example, a compartment of a capsule which is made from a flexible film or foil.

A problem encountered with multi-component systems is that the components in their natural form may have different rheologies. For example, they usually have different viscosities and fluid characteristics as a result of the different chemical composition, and in many cases they will also include particles with different grain sizes. For example, one component might exhibit a significant thixotropic characteristic (viscosity decreasing under shear) or a significant dilatant characteristic (viscosity increasing under shear).

One problem with using a capsule to hold the component is that it has a flexible compartment wall, and where compartments containing components with different viscosities are arranged adjacent one another within a rigid sleeve of a dispensing device, applying pressure to one results in the more viscous component exerting pressure laterally against the compartment of the less viscous component. This creates a higher pressure at the dispensing end of the compartment of the less viscous component compared to the compartment of the more viscous one, which in turn affects the mixing ratios that are achieved at the dispensing outlet of the device. This problem is less significant where a more viscous component only forms a small proportion of the final mixture, for example, where the ratio of the less viscous component to the more viscous component is, say, 10:1. However in more even concentrations, or when there is a greater proportion of the more viscous component, the effect is more noticeable, particularly where there is still a large amount of component to be dispensed.

One solution is to modify at least one of the components in order to try to match the rheologies under normal operating temperatures and pressures. Once matched, a single piston applying pressure to the tail end of a multi-component capsule or capsules should dispense the contents reasonably evenly in volume amounts proportional to the volumes of the respective compartments. These volumes can be set to achieve the appropriate mixing ratios, such as one to one, two to one, three to one, etc.

However, it is not always desirable to modify the components. For example, the components used in their unmodified form may have already gained an established track record and become recognised as achieving certain standards and approvals.

Another solution is to keep the capsules separated, for example, by housing them in individual rigid chambers that have their own pistons for each component. An example of this can be seen in EP-A-0541972. A problem addressed by this dispensing device is that a component can leak from around the opening of the capsule, back along the inside of the cylindrical housing. To avoid this, a ring is adhered to the neck of the capsule before it is cut open and installed within the housing. The ring has a conical outer surface that engages a corresponding conical sealing surface of a hole provided in a plate within the housing. When pressure is exerted by a piston, the conical surfaces seal against one another to prevent component from leaking back.

It would be desirable to make improvements that allow components having different rheological characteristics to be used reliably in a dispensing device that uses collapsible bag compartments housed within the same rigid, elongate sleeve.

It would further be desirable to achieve this without modification of the components, for example in the situation where a first component is a thick, viscous liquid and the second component is a much runnier, free flowing liquid; while at the same time ensuring that the components are dispensed reliably in the appropriate amounts as the contents of the dispensing device are discharged.

According to a first aspect, the present invention can be seen to provide a dispensing device for an inter-reactive, multi-component composition comprising a plurality of collapsible bag compartments located within a substantially rigid housing, the housing being in the form of an elongate sleeve that acts as a guide tube for a compression device and the compartments each housing a component of the multi-component composition, the compartments extending longitudinally, adjacent each other, within the sleeve and having transverse cross-sectional areas that are generally proportional to an intended volume mixing ratio for the multi-component composition, each compartment further having an opening at a dispensing end thereof that is able to communicate with a device outlet at one end of the housing, and an opposite, sealed end which is located within the guide tube and exposed to pressure from the compression device that in use acts to collapse the compartments simultaneously and dispense the components through the device outlet, wherein the dispensing device further comprises a manifold section downstream of the compartments, the manifold section providing a separate chamber for each component to flow through towards the device outlet and each chamber being provided with an aperture that the dispensing end of a compartment protrudes through for dispensing its component into the chamber, wherein the components have different viscosities at an operating pressure of the compression device, and wherein the chamber of a component that is less viscous at the operating pressure has been modified with a flow control regulator to compensate for extra lateral pressure exerted on the compartment of the less viscous component by an adjacent compartment containing a component that is more viscous at that operating pressure, the flow control regulator presenting a restriction to the flow of the less viscous component that acts to modify the ratio of the components dispensed at the device outlet to achieve a volume mixing ratio that is closer to the intended volume mixing ratio of the multi-component composition.

The flow control regulator provides a small but effective adjustment to the flow of the less viscous component that goes beyond the normal flow regulation provided by the resistance of the component passing through the chamber itself. Thus it provides a restriction that helps to counteract the effects of the extra flow arising from the lateral forces that are exerted on the compartment of the less viscous component by the more viscous component during operation. As a result, the flow is balanced as far as possible so that the compartments are collapsed at equal rates, and dimensional stability of the compartments is maintained during use. Preferably the manifold section is made to a standard design and the flow through one or more of the chambers is adjusted through the selection of a specific flow control regulator to achieve a better volume mixing ratio at the device outlet.

The flow control regulator may take many forms.

In one embodiment the flow control regulator comprises a smaller aperture into the chamber of the manifold section, through which the dispensing end of the collapsible bag compartment protrudes. The aperture acts as a throttle to restrict the flow, and the size of the aperture will determine the amount of restriction that is applied. Thus for equal volume mixing ratios, the apertures into the chambers of the manifold section for the different components may be of different sizes; a smaller aperture will restrict the flow of a component more than a larger aperture and the relative sizes of the apertures can be selected in order to balance the internal pressures within the compartments and achieve a mixing volume ratio that is closer to the intended one. Where the components are not intended to be mixed in equal volumes, then the aperture sizes may already be different to account for the different dispensing volumes, for example, by having opening sizes (i.e., areas) that are proportional to the intended volume mixing ratios. In such situations, the aperture of a component that is less viscous during dispensing at a given operating pressure may be made smaller than the opening size determined by the proportions of the intended volume mixing ratio, in order to compensate for the extra lateral forces exerted on its compartment by an adjacent compartment of a more viscous component.

The apertures into the chambers of the manifold section may have fixed dimensions and provide a static restriction of a given size, the effect of which would be proportional to the rate of flow of the components through the apertures, which in turn is determined by the pressure applied by the compression device. Preferably the aperture size is selected to provide a volume mixing ratio that is as close to the intended one for as much of the movement of the compression device as possible at a typical operating pressure of the compression device.

More preferably, one or more of the apertures into the chambers of the manifold section are configured to modify the amount of restriction they offer in response to the pressure applied by the compression device. Thus the aperture may provide a dynamic restriction, through having a variable aperture that increases in size as more pressure is applied by the compression device and reduces in size when the pressure is removed. Preferably the aperture is in the form of a biased opening, for example, a resilient orifice. The apertures to the chambers in the manifold section may have different dynamic properties and open up by different amounts at given levels of operating pressure. In this way different rheological characteristics can be compensated for.

The aperture is preferably provided as a separate ring-shaped aperture member that is introduced into a correspondingly sized receiving hole in the manifold section. Form-fitting surfaces may be provided on the ring-shaped member to seat it in a sealing manner against the manifold section. An adhesive or sealant could be used to secure the ring-shaped member to the manifold. Preferably the ring-shaped aperture member snap-fits into the receiving hole of the manifold section. A resilient lip may be provided on a circumferential surface of the member to snap over a surface on the manifold section to lock it in place and prevent removal. The manifold section may be provided with a standard size of receiving opening and different ring-shaped aperture members with appropriate aperture sizes may be selected to compensate for differences in the rheologies of the components and/or the intended volume mixing ratio of the components. The dispensing device may be fitted with all static or all dynamic apertures, but for certain multi-component compositions, a combination of static and dynamic apertures may be more desirable depending on the rheologies of the components.

The flow control regulator may also comprise a flow restricting member downstream of the aperture, for example, a ring or other shaped element, that is inserted into one or more of the chambers of the manifold section. In one embodiment the flow restricting member comprises a mesh insert. The flow restricting member would reduce the effective cross-sectional area of the chamber and thereby restrict the flow through the chamber. It may be a static restriction (e.g., a solid member or mesh) or a dynamic restriction (e.g., a hollow resilient ring or flexible baffle in the chamber). A chamber may include one or more such flow restricting members between the aperture and the device outlet. A combination of static and dynamic flow restricting members may be chosen for a particular chamber. A static flow restricting member may also be selected for one chamber and a dynamic flow restricting member selected for another. Preferably the chambers are configured to a standard size and a particular size of flow restricting member is selected for the components to be dispensed and inserted into one or more of the chambers.

The flow control regulator may also comprise a hole in a plate or cover which extends across one or more of the chambers, for example near or at the device outlet. The size of the hole is selected to provide a restriction to the flow of the less viscous component that compensates for the imbalance of the compartment pressures resulting from differences in the rheological characteristics. In one embodiment, the manifold section includes a blanking plate that extends near or at the device outlet across all of the chambers and holes of different sizes are formed in the plate to balance the flows and achieve a mixing volume ratio that is closer to the intended mixing volume ratio of the multi-component composition. The holes could be formed during moulding or they could be drilled, punched, melted or otherwise formed in the plate or cover during the assembly process. Thus for a 1:1 volume mixing ratio, a smaller hole may be formed in the plate closing off the chamber of the component that is less viscous at the operating pressure and a standard size or larger hole may be formed in the plate closing off the chamber of the more viscous component. For other volume mixing ratios the hole sizes (i.e., relative areas) may be initially selected in proportion to the intended volume mixing ratio, and then modified by reducing the size of the hole for the less viscous component to compensate for the extra lateral forces that it is subjected to.

The flow control regulator could also take the form of a cap or nozzle that fits over the device outlet, the cap or nozzle having holes, preferably pre-formed holes or passages that have areas corresponding to the intended volume mixing ratio of the components as modified to compensate for the different rheologies of the components.

The dispensing device may also include a combination of any such flow control regulators in any given chamber of the manifold section.

Viewed from another aspect, the present invention can be seen to provide a dispensing device for an inter-reactive, multi-component composition comprising a plurality of collapsible bag compartments located within a substantially rigid housing, the housing being in the form of an elongate sleeve that acts as a guide tube for a compression device and the compartments each housing a component of the multi-component composition, the compartments extending longitudinally, adjacent each other, within the sleeve and having transverse cross-sectional areas that are generally proportional to an intended volume mixing ratio for the multi-component composition, each compartment further having an opening at a dispensing end thereof that is able to communicate with a device outlet at one end of the housing, and an opposite, sealed end which is located within the guide tube and exposed to pressure from the compression device that in use acts to collapse the compartments simultaneously and dispense the components through the device outlet, wherein the dispensing device further comprises a manifold section downstream of the compartments, the manifold section providing a separate chamber for each component to flow through towards the device outlet and each chamber being provided with an aperture that the dispensing end of a compartment protrudes through for dispensing its component into the chamber, wherein the components are required in different volumetric amounts to provide the intended volume mixing ratio, and wherein the chamber of a component that is required to be dispensed in a smaller volume has been modified with a flow control regulator to compensate for the different volumetric amounts, the flow control regulator presenting a restriction to the flow of the smaller volume component that acts to reduce the volume of flow through the chamber, and thereby modify the ratio of the components dispensed at the device outlet to achieve a volume mixing ratio that is closer to the intended volume mixing ratio of the multi-component composition.

The previously described preferred features apply equally to this aspect as the first aspect, as too do the preferred features below. Accordingly any references to preferred features can be read in conjunction with either aspect. By means of this second aspect, a standard size of manifold section can be provided and one or more flow control regulators can be incorporated to adjust the flow to suit the intended volume mixing ratio of the multi-component composition.

With regard to either aspect, while the housing could be moulded in two halves with an integral manifold section, preferably the manifold section is a separately moulded component that is provided as an insert for the elongate sleeve of the housing. In this way, the elongate sleeve can be made of a different material, for example, a cardboard or other fibrous material, preferably made from recycled materials. The manifold section, e.g., injection moulded in plastics, may provide the shoulders of a dispensing device that is in the form of a cartridge which can be loaded into a dispensing gun, for example, a standard mastic gun.

The collapsible bag compartments are provided by one or more capsules housed within the elongate sleeve. The compartments may be arranged side by side as an integral package or capsule, or they may be provided as separated collapsible bag compartments, e.g., as two or more capsules arranged side-by-side within the elongate sleeve. A single compression device is arranged to apply pressure to the components simultaneously.

In preferred embodiments, one or more of the apertures into the manifold section are provided as biased openings having an aperture portion comprising a ring of resilient fingers or other such elements and a body portion comprising a ring of material that a base of the resilient fingers or elements extend from. The apertures may be integrally formed with the manifold section, though more preferably they are moulded separately as ring-shaped members and joined to the manifold section, either during the manufacturing operation or during the assembly of the dispensing device. Each ring-shaped aperture member is preferably secured to a neck of the collapsible bag compartment using an adhesive or sealant, such that the dispensing end of the compartment protrudes through the ring-shaped aperture member. This helps to prevent a component leaking into the sleeve, which is not only desirable from the point of view of mess but also for accurately controlling the flow of the components.

Preferably the one or more biased openings of the manifold section also function as a valve. Thus it may allow a component to be dispensed when pressure is applied to the collapsible bag compartment, but also shut off flow from the compartment when pressure is no longer applied. In one arrangement the biased opening is able to act as a valve by itself and under its own resilience. In another, the biased opening requires an additional component that is adapted to cooperate with it and close down the biased opening in order to close off and seal the compartment. This may be in the form of a resilient element such as a stretchable band.

An advantage of this arrangement is that the valve can seal the compartment to prevent leakage. The presence of a valve allows the capsule to be ruptured at the factory during the assembly process, and the dispensing device is then 'ready for use', i.e., ready to dispense its contents without the user having to cut off sealing clips and re-fit the capsule(s). It can also allow partial discharge of the contents and then re-use after a period of time. A valve can also help to prevent a component from leaking back along the inside of the sleeve.

Although systems are known that have sealing clips which are arranged to "pop off" once initial pressure is applied to the capsule, there can be variance in the clip properties as a result of the manufacturing process and this can make the clips unreliable. This can be exacerbated when the compartments contain components with different rheologies. By pre-removing the clips during the production of the dispensing device, it removes this source of unreliability. It also prevents the clips from potentially blocking the dispensing device. This allows the dispensing device to be used with any type of mixing nozzle, whereas previous products required a specific nozzle to ensure catching the clip without blocking. While it is preferable to use pre-ruptured capsules, the dispensing device could also be used in conjunction with self-rupturing capsules where the capsule is provided with a weakened area that ruptures under pressure, for example, where a seal formed by welding or through using an adhesive that is intended to rupture under application of pressure by the user.

The manifold section is preferably an insert that is secured within the sleeve at the dispensing end. The insert may fit up against an existing shoulder portion of the dispensing device, but more preferably it provides the complete shoulder portion of the dispensing device. For example, the insert may be of circular form having an external diameter or a region of external diameter corresponding to an internal diameter of the elongate sleeve. Frictional engagement alone may suffice to keep the manifold section attached to the sleeve, since in use, the connection between the manifold section and the sleeve would be under compression between the collar and the piston of a dispensing gun. Alternatively an adhesive or mechanical elements, such as lugs and recesses may be used to secure the parts together. In an alternative arrangement, the manifold section may have a collar that fits externally of the elongate sleeve.

The manifold section is preferably moulded as a single piece, for example, having circular form when viewed along a longitudinal axis. A circular cross-section is standard and would allow use in generic dispensing guns but other shapes would work equally well, such as oval cross-sections, or polygonal cross-sections (triangular, square, hexagonal, etc) with an appropriately shaped dispensing gun. For certain applications it may be preferable to mould the insert as several pieces that are either joined together, for example, by welding, or are held together by other parts of the dispensing device. In one embodiment the manifold section is provided by a funnel shaped section and a portion providing the apertures into the chambers is mounted upstream of it through interlocks with the elongate sleeve.

In a number of embodiments, the biased openings may not perform any additional function other than serving to locate properly the dispensing ends of the collapsible bag compartments. For example while the resilient fingers may grip the neck of the compartment sufficiently well to hold it in place within the sleeve of the dispensing device, they may not have sufficient bias to close off and seal a compartment, and may not significantly alter the flow of the component during use. In such embodiments, preferably the biased opening is a ring-shaped aperture member having an aperture portion and a ring-shaped body portion, that is attached to the compartment, for example, with an adhesive or sealant, and interlocks with the manifold section in a snap-fitting manner to locate the dispensing end of the compartment in position.

Thus according to a third aspect of the present invention, there is provided a dispensing device comprising a substantially rigid, elongate sleeve that is able to receive a piston at one end, one or more capsules fitted within the sleeve, the capsule or capsules comprising one or more flexible film or foil packages containing two or more components housed within elongate compartments defined by flexible film or foil, each compartment being ruptured or being capable of being ruptured at a dispensing end that is spaced from a dispensing end of the next compartment, the one or more flexible film or foil packages being sealed at the opposite end where the piston will apply pressure, wherein the dispensing device includes an insert within the sleeve that partitions the compartments from a device outlet of the dispensing device, the insert being provided with a biased opening for each dispensing end of each compartment, the biased opening in each case fitting over the dispensing end of the compartment such that the flexible film or foil of the compartment extends through the biased opening towards a point of rupture, and wherein each biased opening is provided by a separate ring-shaped aperture member that locks into position in the insert in a snap-fitting manner.

The biased opening in these embodiments preferably comprises the resilient finger arrangement described above to provide an aperture portion offering a variable aperture. However, other arrangements are possible where the biased opening is providing just a locating function for a dispensing end of the capsule. For example, the biased opening may comprise a plurality of overlapping resilient elements that act to grip the neck of the compartment, or it may comprise a stretchable band or grommet that the dispensing end of the compartment can be pushed through and is gripped thereby. It could also comprise a relatively open aperture and be made from a fairly rigid material that, although it may have sufficient resilience to snap into locking engagement with the manifold, may not distort to any significant extent during dispensing. Preferably the compartment is adhered to the biased opening to prevent leakage.

In addition to this locator function, the biased opening may further provide a valve or regulator function. Preferably, the biased openings are as previously described, are pre-fitted to the capsule before it is inserted into the sleeve.

Preferably each biased opening is a regulator that is able to open in response to pressure within the compartment of the capsule and thereby restrict the flow and regulate the pressure or flow at the dispensing end of its compartment. When the components in the capsule have different rheological properties, each regulator may be adapted for the rheological properties of the component in its compartment. The regulators may, for example, be adapted or selected so that the pressures at the dispensing ends of the different compartment, in use, are substantially the same. They may also be adapted or selected so that the different components have substantially the same flow, taking into account any differences in rheological characteristics, as the components exit the compartment. It is important that the flow is balanced as far as possible as this leads to greater dimensional stability of the capsule(s) during use. Preferably the regulators are adapted or selected so that the mix ratio of the components remains the same throughout the whole process of dispensing the capsule(s) contents. For example, in the situation where a stiff component is provided in a compartment next to a runnier component, the different transmitted pressures and in particular the lateral pressure exerted on the compartment of the runnier component by the stiffer component, can be taken into account in the choice of the regulators to provide a more controlled mixing. The regulators may be moulded in different colours to facilitate easier assembly at the production line. A restriction for one or more of the components may also be incorporated further downstream to control the mixing characteristics of the dispensing device further. This could be a static or a dynamic constriction.

Such an insert with its regulators in the form of biased openings, is intended to provide a simplistic mechanism for regulating the flow in what is usually a disposable item. Consequently, while equalisation of pressures and/or flow is aimed for, in practice the pressures generated or the flow achieved in use, may be close though not exactly the same. The main thing is to try to ensure dimensional stability of the compartments as they are being squeezed. For this reason, the phrase "substantially the same" should be interpreted with this in mind.

The insert may comprise a manifold section provided as two mouldings, e.g., as two semi-circular or other shape elements arranged back-to-back, each providing a manifold to direct one of the components to the dispensing outlet of the dispensing device. In this way the manifold can prevent the component from leaking back along the sleeve after it has passed through the biased opening. The manifold also serves to locate the biased opening, whether it is acting as a valve or as a regulator or just as a general support for the neck of the compartment, at an appropriate position within the sleeve. The manifold section may also be further provided with constrictions to adjust the flow rate of a component exiting the manifold.

Certain preferred embodiments of the present invention will now be described in greater detail and by way of example only, with reference to the accompanying drawings, in which.

Figure 1:
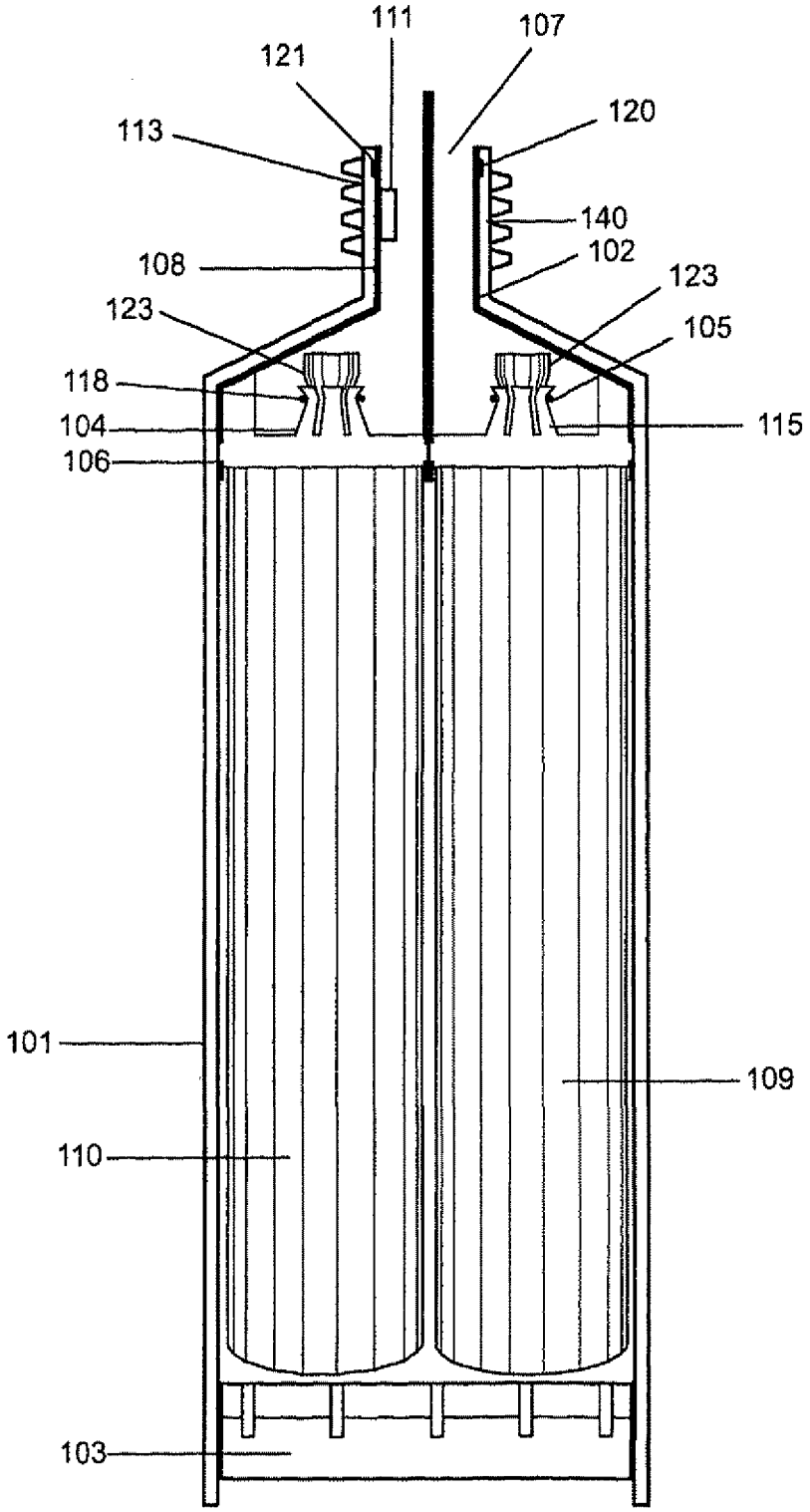
FIG. 1 is a cross sectional view of a dispensing device with two rheologically dissimilar components incorporating a preferred flow control regulator of the invention.
Figure 3A:
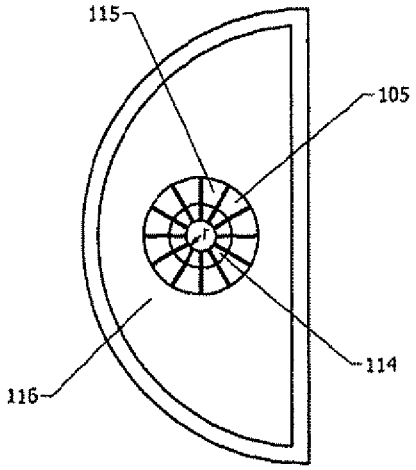
Figure 3B:
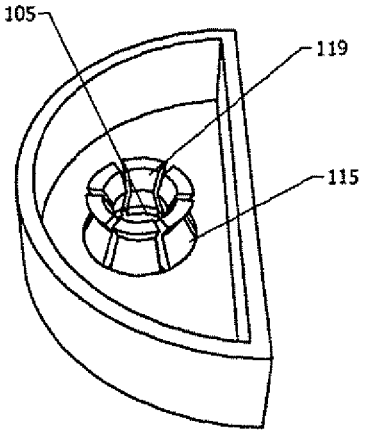
Figure 4:
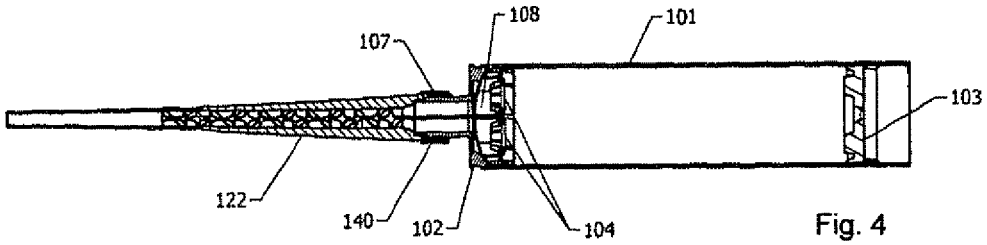
Figure 5:
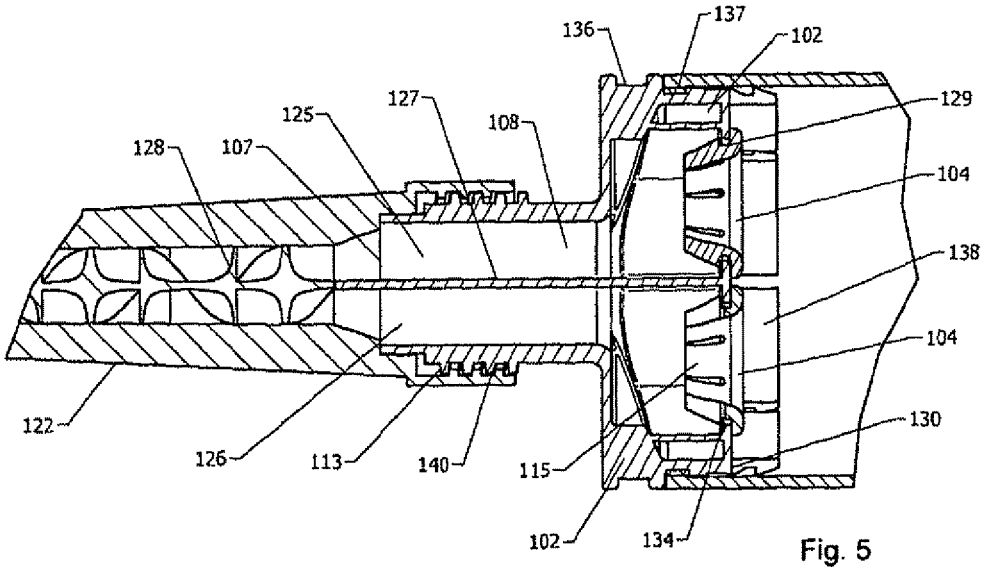
Figure 6:
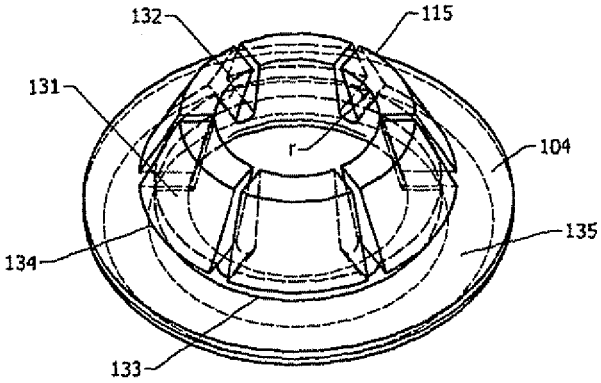
Figure 7:
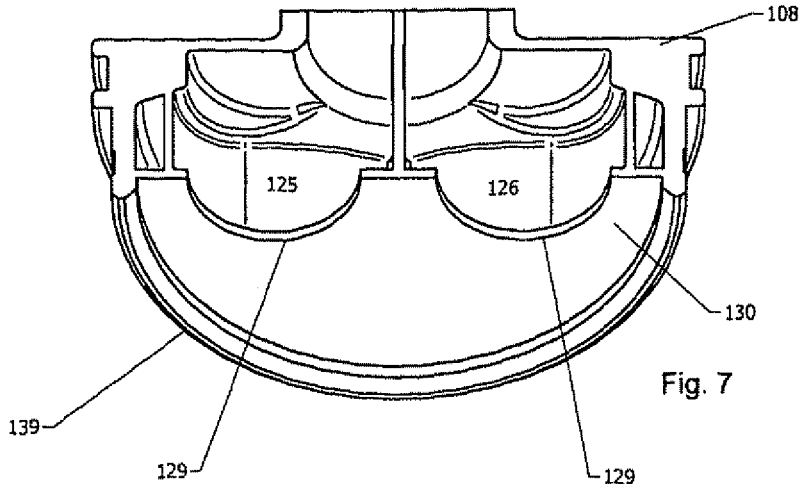
Figure 8:
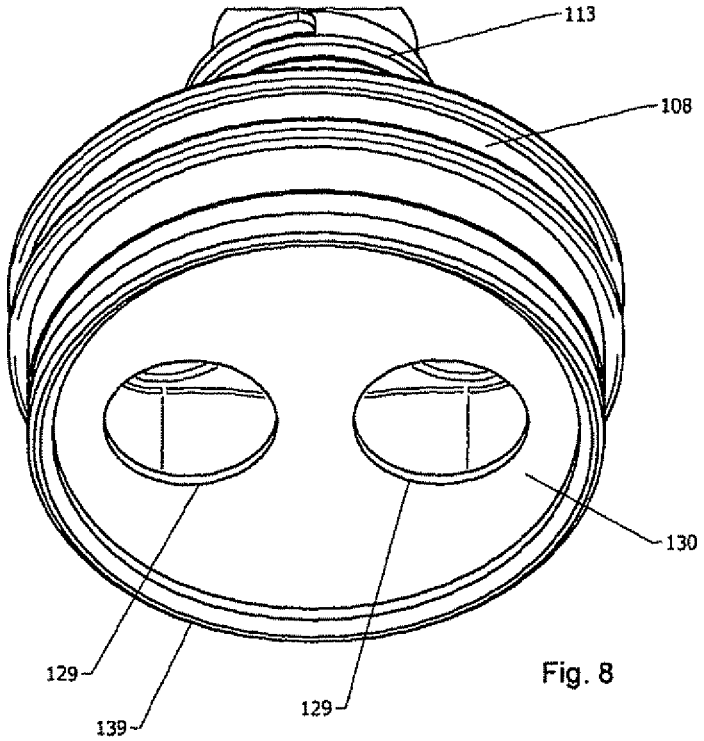

FIGS. 3*a* and 3*b* show a valve arrangement for use in the embodiment of FIG. 1;

FIG. 4 is a longitudinal cross-sectional view of a dispensing device in accordance with a further embodiment of the present invention;

FIG. 5 is an enlargement of the preferred manifold section illustrated in the embodiment of FIG. 4;

FIG. 6 is a perspective view of a preferred ring-shaped aperture member for use with the manifold section of FIG. 5;

FIG. 7 is a sectional perspective view of a further preferred manifold section; and FIG. 8 is a perspective view showing the side of the manifold section in FIG. 7.

The present invention relates to dispensing devices that are preferably in cartridge form for dispensing inter-reactive multi-component compositions. Cartridges containing such compositions are known in various forms. Generally they comprise two or more separate compartments, each housing a respective component. The present invention is particularly concerned with cartridge systems that house the components within collapsible flexible bags. These components, in use, are extruded or otherwise expelled through an opening in their respective compartments into a static mixing device, where they are caused to mix and react together. The dispensing apparatus includes a piston that applies axial pressure to the bag to squeeze the component from the bag. The bag is contained within a more rigid structure in the form of a sleeve which also serves as a guide means for the piston. The piston is usually provided by way of a pressure plate, which is housed within and guided by the internal surface of the sleeve, and an actuating member of the dispensing apparatus, which may itself be in the form of a piston, that urges against and applies axial pressure to the pressure plate.

Variation in rheology between the components causes the volume mixing ratio to vary during the extrusion process. To solve this problem, according to one preferred embodiment of the present invention there is provided a dispensing device for an inter-reactive multi-component composition comprising a collapsible bag located within a substantially rigid housing and defining a plurality of compartments; each compartment housing a component and having an outlet at one end of the collapsible bag that is able to communicate with a dispensing formation at one end of the housing; the other end of the collapsible bag located within the guide tube in use being exposed to a compression device acting to collapse the collapsible bag and dispense component through the outlet; wherein there is provided additionally a flow control regulator on the outlet of each compartment to control the flow rate from said outlet.

A suitable flow control regulator is a flow restrictor that restricts the flow of material through the outlet. The flow restrictor may comprise a formation which limits the area of the aperture of the outlet dynamically to a varying extent during use.

In use, a single compression device is used to apply pressure to the two or more compartments to urge the contents out of the outlet. The rate of flow of a component from its compartment is modified individually to equalise the flow for a given applied pressure from the compression device through the action of the flow control regulator. In other words, the flow characteristics for each outlet can be set to be different. Each compartment may have an outlet that is restricted differently in terms of its aperture size. For example, the apertures for the different compartments may have a different aperture area at a particular operating pressure within a range of pressures exerted by the compression device.

By appropriate differential selection, flow rates can be balanced between multiple compartments subject to the same applied pressure from the common compression device even when they contain components of different rheologies. To effect this, a flow control regulator having chosen flow characteristics may be provided around the neck of the collapsible bag compartment. Such an arrangement balances the flow of the components as they are extruded from different compartments to facilitate mixing of theologically dissimilar components in the correct volume mixing ratio throughout the extrusion process where pressure is applied from the single compression device to the compartments simultaneously in a single cartridge housing.

The dispensing device comprises a collapsible bag or bags defining a plurality of compartments located in a substantially rigid housing. The housing has a manifold section into which each compartment of the collapsible bag or bags feeds its respective component via an opening at a first, dispensing end of the compartment in use under action of a compression device at the opposite end of the compartment. The collapsible bag compartments house multiple flowable reactive components which are intended to be mixed together when dispensed. The collapsible bag may comprise a flexible bag having multiple compartments, each for a single component of a multi-component system, or the collapsible bags may comprise a plurality of single compartment flexible bags or a combination of these options. The dispensing device is particularly suited to a system where a plurality of flexible bags (capsules) are provided, each flexible bag defining a single compartment for a single component of a multi-component system.

Referring to FIG. 1, a preferred dispensing device of the cartridge type for two rheologically dissimilar components is shown in longitudinal cross section. The housing 101 provides a rigid support structure for the collapsible bag 109, 110. The housing is substantially rigid, for example comprising a rigid plastics material, a cardboard material etc. It defines a hollow elongate tube of circular or substantially circular cross-section that surrounds and contains the collapsible bags. The housing 101 also serves as a guide tube for the compression device in use. The compression device moves along within the housing in a longitudinal direction. The compression device is a piston deployable longitudinally within the guide tube 101 to apply compression to the collapsible bags 109, 110 housed within.

The example system is a 1:1 epoxy adhesive composition. This is an example only. The invention is not limited to two component systems or to 1:1 stoichiometry.

Such a composition is well known. The composition has two fluid components, one of which (component A) is typically a thin paste and the other (component B) is typically a highly thixotropic paste.

Each component is provided in a flexible bag 109, 110. A first bag 109 is a single compartment, single component, flexible membrane bag filled with component A. A second bag 110 is a single compartment, single component, flexible membrane bag filled with component B. The bags as a result form elongate sausages.

A typical collapsible bag compartment 109, 110 is elongate and filled in the manner of a sausage, cut to the desired length, and sealed at both ends. In use, a first end is opened in a suitable manner to allow the contents to be dispensed. The second end remains closed and arranged to receive pressure from a compression device.

The collapsible bag compartments may contain any suitable inter-reactive set of components that are intended to be mixed together. These include but are not limited to any two part resin and hardeners/catalysts, for example, adhesives such as epoxies, polyesters, vinyl esters, etc, sealants such as silicones, acrylates, acrylics, polyurethanes, polyureas, etc. The compartment is formed using a thin film of any suitable material, for example, a polymer such as polythene, or made be made from a flexible metal foil, etc. The compartments may be of different volumes and may contain different amounts of components, and they may be joined together as appropriate. In one embodiment the dispensing device has two compartments of equal size for a 1:1 mixing ratio. In another, the dispensing device has a first compartment that is twice the volume of a second compartment for 2:1 mixing ratio. In a further example, the dispensing device has a first compartment which is three times the volume of the second compartment to provide a 3:1 mixing ratio.

The bags 109, 110 are housed side by side in a tube 101 to form a cartridge that wholly encloses and houses the bags. The dispensing ends of the collapsible bag compartments 109, 110 are located within an insert 102, which provides a manifold section that is housed within the shoulders of the housing 101. The guide tube 101 also acts as a means in which the piston 103 may slide to bring pressure to bear on the bottom end of each elongate sausage to extrude the fluid component out of the opening 123 at the top of each bag 109, 110.

A difficulty arises in such a system because of the very different component rheologies. The piston 103 applies the same compressive force to each bag 109, 110. However, the different rheologies mean that the stiffer component will generate greater lateral pressures adding to the internal pressure of the more fluid component. As a result different pressures are generated to drive the extrusion process, which in turn leads to variability in the mixing ratios between the two components during the course of the extrusion process. Since the mixing ratio in the example system is of considerable importance in producing an effective reaction product (in this case, settable epoxy adhesive which will achieve maximum strength only when mixed in the correct proportions) such variability is a serious technical problem.

This is addressed in the example illustrated by means of several features.

Each opening 123 of the bags 109, 110 feeds into an inlet of the manifold 108 at an outlet end of the tube 101. The manifold 108 is designed to direct the flow of the components from the two or more bags 109, 110 to the outlet 107 of the tube 101. The manifold 108 initially defines separate chambers or channels for the components to flow from each bag 109, 110 to a manifold outlet 107. The outlet 107 has a screw thread 113 for attachment of a dispensing unit (not shown) which may include a dispensing nozzle, static mixer body etc.

At the point where each bag opens into its respective chamber of the manifold 108 a ring-shaped aperture member is located. The manifold serves as a convenient means to locate the aperture member 104, in the form of a flexible elastomeric ring structure 105, seated to surround the bag opening 123. This structure is shown in further detail in FIG. 3, in plan view in FIG. 3*a* and in perspective view in FIG. 3*b*.

An aperture member 104 may engage with a suitable portion of the manifold 108 by simple interference fit, but in the example embodiment a positive lock locator 106 comprising a complementary ridge and recess is envisaged, in this case with a recess in the manifold 108. This serves to locate the aperture member 104 in position. In effect the manifold/aperture member arrangement thus has the additional function of providing an effective mechanical engagement of each bag 109, 110 in position to feed into the chambers within the manifold 108, avoiding the need for further specific structures for that purpose.

Figure 2:
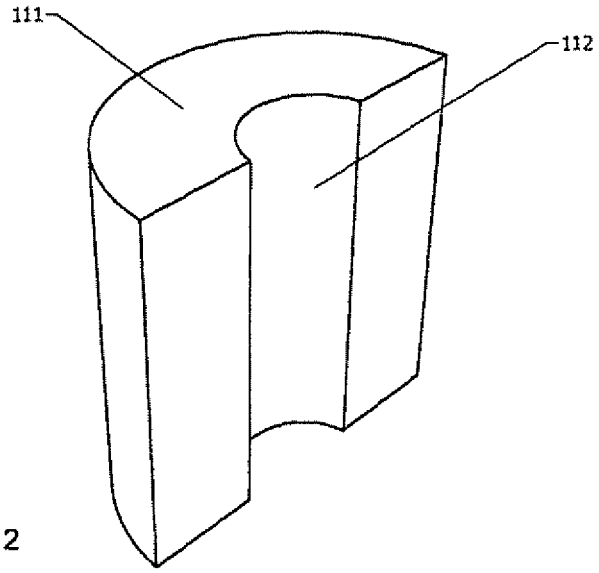
FIG. 2 is a flow restricting member for use in the embodiment of FIG. 1.

A flow restricting member 111 defining a reduced flow passage 112 as shown in more detail in FIG. 2 seats in the chamber of the manifold serving the highly thixotropic component B. Under an operating pressure of the piston 103, the viscosity of component B will decrease, and in this example, does so significantly below that of component A. The flow restricting member 111 provides a restriction that helps to balance the flow of the two components out of the manifold and maintain the correct mixing ratio. Additionally or alternatively the aperture members 104 may be differently constructed to this end, for example with different outlet sizes, having different material physical properties, comprising variable strength elastomeric outlet restrictors such as rings or springs etc. In this manner the flow of each rheologically different component may be balanced to achieve a constant flow rate under action of the piston, reducing the tendency for the bag containing the less thixotropic component to deform excessively, and helping to maintain the mixing ratios between the two components throughout the extrusion process.

The aperture members 104 provide a biased opening each having an aperture portion 114 comprising a plurality of elements 115 that are arranged to open under pressure, for example, such as a plurality of resilient fingers. The elements 115 are arranged to converge under their own bias to urge against the outer surface of a neck of a compartment, trapping the gathered material therebetween. These elements or fingers 115 may not close down entirely, but preferably leave a small opening equivalent to the thickness of the gathered material of the neck of the compartment. The biased openings also have a body portion 116 from which the plurality of elements extend. The aperture members 104 may also be moulded separately to the manifold section 108 and are configured to engage a receiving hole in wall 124 that partitions the manifold section from the collapsible bag compartments, preferably securing to it in a snap-fitting manner, as shown in FIGS. 4 to 6. In this way each compartment or capsule 109, 110 can be pre-fitted with a ring-shaped aperture member 104 that fits over the neck of the compartment 109, 110 and may be secured in place with an adhesive or sealant. The sealing clip 117 may be removed so that the compartment 109, 110 is ready to dispense its contents when required, and the compartment then pushed up the sleeve until the aperture member 104 engages, preferably in a snap-fitting manner or with an adhesive/sealant, within a corresponding receiving hole in the manifold section. The compartment is then held securely in place by the aperture portion 114 of the biased opening 104.

The biasing force from the ring of flexible elements 115 is a reaction to the pressure within the compartment driving the flow and, together with the effect of the change in size of the orifice, can act to restrict the flow and/or regulate the pressure at the dispensing end of a compartment. The biased opening can be formed to have a non-linear regulating characteristic in response to the build up of pressure within the compartment.

As shown, the ring of flexible elements 115 comprises a collar or nozzle of resilient fingers. The innermost surface of the fingers 115 provides a cup-like recess in which to seat the dispensing end of the compartment. The fingers converge towards a point and may abut one another in a closed configuration to create a substantially frusto-conical form. In the closed configuration a small opening of radius r may remain to accommodate a neck of the flexible film or foil forming the collapsible bag compartment 109, 110. With the neck of the compartment gathered by the aperture member 104, the flow of the component can be stopped and so the aperture member 104 could also provide a valve function. When pressure is exerted, the contents of the compartment 109, 110 will cause the fingers 115 to splay out, enlarging the orifice. The fingers 115 will be biased against the surface of the flexible film or foil through the resilience of the material. Additional biasing may be provided through a stretchable ring 118 that extends around the collar, for example, using elastomeric rings 118 of different elasticity or thickness to adjust the biasing provided to the collar. The collar may be provided with a retaining formation on an outer surface for retaining an additional biasing element in position around the collar, for example, an elastomeric ring or spring clip. The retaining formation 119 might be an outward flaring at the ends of the converging fingers. The flaring provides a rim that retains an elastomeric ring or spring clip in place encircling the collar of fingers.

Preferably the collapsible bag compartments are preformed with a flattened side. Thus the flexible films of the compartments 109, 110 can be moulded using a semi-circular profiled mandrel to form a semi-circular chamber prior to filling for a one to one mixing ratio. This allows the compartments 109, 110 to be brought together at their flattened faces to provide a capsule of circular cross-section. The compartments 109, 110 may have cross-sections corresponding to any segment or sector of a circle, or they may have other shapes where co-operating flattened or profiled faces are joined together to form the completed capsule. Assembling the compartments of a capsule 109, 110 to form a final shape that corresponds to the sleeve 101 of the cartridge or the barrel of a gun, helps to facilitate the insertion of the compartments within the sleeve. Moreover, the two or more compartments 109, 110 can be wrapped in a further film to hold the compartments together, which can additionally help to assist handling.

In addition it can be difficult to provide information on the side of a compartment because the final position of the printed surface may be unpredictable. Using a separate film to wrap the compartments together allows instructions and other printed matter to be provided in a predictable and clear way on the side of an assembled and wrapped capsule. This is particularly useful where the capsule is not used in a cartridge but instead a re-usable dispenser gun. The film wrap may be chosen to have other properties such as a low coefficient of friction with respect to the material of the sleeve or barrel, in order assist with loading the capsule 109, 110 into the cartridge 101 or barrel of a gun. This concept can be applied also where there are more than two components, for example, three or four components, e.g., with the compartments preformed with a cross section corresponding to a sector of a circle.

The manifold section 108 is provided with a locating means to position it correctly within the outer casing and in the embodiment of FIG. 1 this comprises a projection 120, for example, a circumferential projection 120 which engages with a recess 121 provided in the inner surface of the sleeve or neck of the dispensing apparatus. The projection and recess 120, 121 are easily formed during the moulding operations. In another embodiment (not shown), the locating means comprises a plurality of projections. The locating means could also comprise a circumferential rim which engages an annular recess in the sleeve similar to the positive lock locator 106 locating the aperture members 104 in the manifold section 108.

As shown in FIGS. 4 and 5, the manifold section 108, which is in the form of an insert 102, could also be moulded to provide the whole of the shoulders, i.e., the conical region, that leads the components to the mixing nozzle 122 of the cartridge. Such an insert 102 would be used in conjunction with a tubular sleeve 101 to provide the complete dispensing end of the cartridge. This has additional benefits as the tubular sleeve 101 is much easier to manufacture than an injection moulded outer casing with integral conical surfaces at one end. Preferably the tubular sleeve 101 is made from a recyclable material. In one embodiment, the tubular sleeve 101 is a cardboard roll.

In the embodiment of FIGS. 4 and 5, the collapsible bag compartments 109, 110 have been omitted for ease of understanding. When the device is fully assembled, these would be housed within the elongate sleeve 101 between the compression device (piston) 103 and the manifold section 108. The manifold section 108 is shown in more detail in the longitudinal cross-sectional view of FIG. 5 and the perspective views of FIGS. 7 and 8. It is preferably formed by injection moulding and may be moulded as two or more pieces that are fixed together, for example, by welding to form the completed article or alternatively it could be moulded as a single article. The manifold section 108 defines a chamber 125, 126 for each component to pass through after it has been dispensed from the collapsible bag compartment 109, 110 to reach the outlet 107. In the embodiment shown there are two chambers 125, 126 for a two-component mixture. The components are kept separate within their chambers 125, 126 up to the outlet 107 by a dividing wall 127. Once the components pass through the outlet 107, they are mixed together by the mixing blades 128 of the static mixing nozzle 102. The entry into each chamber 125, 126 of the manifold section is provided by a ring-shaped aperture member 104, which snap fits into a receiving hole 129 provided in a wall 130 of the manifold section 108 that partitions the chambers 125, 126 from the region where the components are housed. When assembled, the dispensing end of a collapsible bag compartment protrudes through the ring-shaped aperture member 104 into the respective chamber 125, 126.

The ring-shaped aperture member 104 is shown in greater detail in FIG. 6. It comprises a ring-shaped body portion 116, from which a plurality of elements 115 extend to define a collar 131 leading to an aperture 132. In their closed configuration, the elements 115 abut each other along their adjacent edges towards their distal ends, defining a closed radius r. In contrast to the embodiment of FIGS. 1 to 3, the elements 115 are relatively stiff and define a closed radius r that is significantly larger than a gathered neck of compartment material. In other words, the ring-shaped aperture member 104, even in its closed configuration, allows the component within the compartment 109, 110 to flow easily into the chamber 125, 126. In fact, the ring-shaped aperture member 104 may not flex particularly during use and may remain in its closed configuration when normal operating pressures are delivered by the compression device 103.

Before the compartment 109, 110 is introduced into the elongate sleeve 101, a ring-shaped aperture member 104 is fitted over the neck of the compartment 109, 110 and retained in place with an adhesive or sealant. The ring-shaped aperture member 104 is then pushed into a locking engagement with the receiving hole 129 provided in the partition wall 130 of the manifold section 108. The elements 115 are provided with an undercut 133 at their base that forms a circumferential lip 134, which snap fits over the edge of the receiving hole 129 to lock the ring-shaped aperture member 104 in position. A flat circular rim 135 is provided on the surface to seal against the partition wall 130. An adhesive or sealant may also be applied to this area prior to locating the ring-shaped aperture member 104 in the manifold section 108.

As shown in FIG. 5, the manifold section 108 is provided as an insert 102 that slides into engagement with the interior surface of the elongate sleeve 101. An outer circumferential wall of the manifold section 108 is provided with a circumferential groove 136 for gripping by jaws of an assembly tool and a circumferential recess 137 to accommodate the thickness of the elongate sleeve 101. The manifold section 108 is also provided with a set of locating members 138 to grip onto or latch onto the inside of the elongate sleeve 101. In the embodiment of FIGS. 7 and 8, the locating members 138 are replaced with a circular rim 139.

The two chambers 125, 126 in the embodiment of FIGS. 1 to 3, 4 to 6, or 7 and 8 are the same dimensions. During use, the chambers 125, 126 would offer the same resistance to flow of a component at a given pressure. The aperture members 104 in the embodiment of FIGS. 1 to 3 or FIGS. 4 to 6 are also the same dimensions and would provide the same restrictive effect to the components. In order to take account of components having different rheological characteristics, the cross-sectional area of one or both chambers 125, 126, either in the neck region 140 of the manifold section 108 or at the outlet 107, is/are modified by a flow restricting member 111 to provide a small but effective adjustment to the flow of the less viscous component to compensate for the difference in rheological properties. The flow restricting member 111 may be in the form of the semi-circular member shown in FIG. 2 or could be any shape that reduces the cross-sectional area of the chamber 125, 126, for example a different shaped insert, a mesh or even a resilient member which offers a dynamic restriction.

Where the components are not in a 1:1 ratio, the flow restricting member 111 may modify the cross-sectional area of one or both of the chambers 125, 126 according to the intended volume mixing ratio. Thus, for a 1:2 ratio, the flow restricting member 111 may reduce the cross-sectional area of one chamber 125, 126 by half so that the cross-sectional areas of at least that part of the chambers 125, 126 are in a ratio of 1:2. Where the flow restricting member 111 is made longer, and hence takes up more volume within the chamber 125, 126, then the amount of material that is lost when the components are first dispensed can be minimised. In addition the flow restricting member 111 may add a further element of restriction to the less viscous component, which could be the lesser or greater component, in order to provide a back-pressure that compensates for additional lateral pressure that is applied to the compartment of the less viscous component by the more viscous component. In this way, a standard size of manifold section 108 can be provided and moulded in large numbers, and then a particular flow restricting member 111 can be selected and inserted into the chamber 125, 126 of the smaller volume component and/or less viscous component, in order to compensate for the different flow volumes and/or flow characteristics. The manifold section 108 may be moulded in ratio sizes other than 1:1, for example, 1:2, 1:3, etc, depending on popularity, and flow restricting members 111 can be provided to offer other ratios, e.g., 1:1.5 (2:3), 1:2.25 (4:9) etc. Where particular volume mixing ratios prove to be particularly popular, manifold sections 108 could be moulded with integral flow restricting members to offer those volume mixing ratios and additional flow restricting members can be added to compensate for rheological differences.

Ring-shaped aperture members 104 having different aperture sizes 132, could also be used to compensate, either separately or in conjunction with other flow restricting members, for volumetric differences in the intended mixing ratio of the components and/or rheological differences between the components.

In addition to such flow restricting members 111 or as an alternative, a plate or cover may be provided extending across one or both of the chambers 125, 126 at or near the outlet 107. One or more holes could be provided or formed in the plate or cover to provide a restricted cross sectional area for the component to flow through. The restricted cross sectional area of the plate or cover can compensate for the differences in a non-equal mixing ratio. It can further compensate for differences in the rheologies of the components.

Thus it can be seen that the present invention provides a dispensing device that can be modified in a variety of ways to compensate for differences in rheology and for volumetric differences to achieve a volume mixing ratio at the outlet 107 that is closer to and preferably matching the intended volume mixing ratio of the components.

According to the following clauses, the present invention can be seen to provide:

1. A dispensing device for an inter-reactive multi-component composition comprising a collapsible bag formation locatable within a substantially rigid housing structure and defining a plurality of compartments; each compartment housing a respective component and each compartment having a dispensing outlet at a first end of the bag adapted to communicate fluidly with a dispensing formation at a respective end of the housing structure; an opposite end of the bag when located within the guide tube being exposed to a compression device acting in use to tend to collapse the bag formation and encourage the components towards the respective dispensing outlets; wherein there is additionally provided an individual flow control regulator in association with the dispensing outlet of at least one of the compartments and preferably each compartment to control the flow rate from said dispensing outlet at a given applied pressure from the compression device.

2. A dispensing device in accordance with clause 1 wherein the a flow control regulator is a flow restrictor that restricts flow of material through the dispensing outlet.

3. A dispensing device in accordance with clause 2 wherein the flow restrictor comprises a formation which limits the area of the aperture of the dispensing outlet.

4. A dispensing device in accordance with any preceding clause wherein a flow control regulator is provided in association with the dispensing outlet of at least one compartment such that the flow characteristics out of different compartments are differentially selected such that flow rates are more closely balanced in use between multiple compartments subject to the same applied pressure from the common compression device 5. A dispensing device in accordance with any preceding clause wherein a flow control regulator is provided in association with the dispensing outlet of each compartment.

6. A dispensing device in accordance with any preceding clause housed for use in a substantially rigid housing structure having a dispensing formation at a first end of the housing structure and a compression device remote from the first end of the housing structure; whereby each dispensing outlet at the first end of the bag fluidly communicates with the dispensing formation at the respective end of the housing structure; and whereby an opposite end of the bag is located within the housing structure such as to be acted upon in use by the compression device to tend to collapse the bag formation and encourage the components towards the respective dispensing outlets.

7. A dispensing device in accordance with any preceding clause wherein at least two of the compartments respectively contain flowable contents of different composition and different rheology.

8. A dispensing device in accordance with any preceding clause wherein the collapsible bag formation comprises a flexible bag having multiple compartments.

9. A dispensing device in accordance with any preceding clause wherein the collapsible bag formation comprises a plurality of flexible bags each defining a single compartment.

10. A dispensing device in accordance with any preceding clause wherein the collapsible bag formation comprises a flexible membrane defining each compartment to house a fluid component.

11. A dispensing device in accordance with clause 10 wherein the flexible membrane is conveniently a flexible material.

12. A dispensing device in accordance with any preceding clause wherein the dispensing formation includes a nozzle through which the mixed components may be dispensed for use.

13. A dispensing device in accordance with any preceding clause wherein the dispensing formation includes a manifold having a separate manifold inlet in fluid communication with each dispensing outlet of a compartment of a bag and defining fluid flow passages from each manifold inlet to a common fluid conduit.

14. A dispensing device in accordance with clause 13 wherein a flow control regulator is located in a manifold flow passage so that the flow rate from the associated compartment can be individually controlled 15. A dispensing device in accordance with any preceding clause wherein a flow control regulator is located on the outlet of a compartment so that the flow rate from the compartment can be individually controlled directly at the outlet.

16. A dispensing device in accordance with any preceding clause wherein a flow control regulator is a valve.

17. A dispensing device in accordance with clause 16 wherein the flow rate through the valve is controlled for by the strength of the material used to make the valve and by the size of the valve outlet.

18. A dispensing device in accordance with any preceding clause wherein the flow control regulator is adapted to vary flow control dynamically during use.

19. A dispensing device in accordance with any preceding clause wherein the housing structure is a hollow elongate tube.

20. A dispensing device in accordance with any preceding clause wherein the housing structure adapted to serve as a guide means for deployment of the compression device in use.

21. A dispensing device in accordance with clause 20 wherein the compression device deploys along the housing structure in an elongate direction and the housing structure is adapted to serve as a guide means for such deployment.

22. A dispensing device in accordance with any preceding clause wherein the compression device is a piston.

The invention claimed is:

1. A dispensing device for an inter-reactive, multi-component composition comprising a plurality of collapsible bag compartments located within a substantially rigid housing, the housing being in the form of an elongate sleeve that acts as a guide tube for a compression device, wherein the compression device is a piston, and the compartments each housing a component of the multi-component composition, the compartments extending longitudinally, adjacent each other, within the sleeve and having transverse cross-sectional areas that are generally proportional to an intended volume mixing ratio for the multi-component composition, each compartment further having an opening at a dispensing end thereof that is able to communicate with a device outlet at one end of the housing, and an opposite, sealed end which is located within the guide tube and exposed to pressure from the compression device that in use acts to collapse the compartments simultaneously and dispense the components through the device outlet, wherein the dispensing device further comprises a manifold section downstream of the compartments, the manifold section providing a separate chamber for each component to flow through towards the device outlet and each chamber being provided with an aperture that the dispensing end of a compartment protrudes through for dispensing its component into the chamber, wherein the components have different viscosities at an operating pressure of the compression device, and wherein the chamber of a component that is less viscous at the operating pressure has been modified with a flow control regulator to compensate for extra lateral pressure exerted on the compartment of the less viscous component by an adjacent compartment containing a component that is more viscous at that operating pressure, the flow control regulator presenting a dynamic restriction to the flow of the less viscous component that acts to modify the ratio of the components dispensed at the device outlet to achieve a volume mixing ratio that is closer to the intended volume mixing ratio of the multi-component composition, wherein the aperture, through which the dispensing end of the collapsible bag compartment of the less viscous component protrudes, is the dynamic flow control regulator, the aperture being smaller than an opening the size of which is determined by the proportions of the intended volume mixing ratio, so that the aperture acts as a throttle to restrict the flow, thereby compensating the extra lateral forces exerted on its compartment by an adjacent compartment of a more viscous component, wherein the dynamic flow control regulator comprises a variable aperture that increases in size as more pressure is applied by the compression device and reduces in size when the pressure is removed to provide a dynamic restriction, and wherein the rates of flow for the components are substantially balanced so that the compartments are collapsed at equal rates, and dimensional stability of the compartments is maintained during use.

2. A device as claimed in claim 1, wherein the aperture, through which the dispensing end of the collapsible bag compartment of the less viscous component protrudes, is a flow control regulator, the aperture being smaller than an opening size determined by the proportions of the intended volume mixing ratio, so that the aperture acts as a throttle to restrict the flow, thereby compensating for the extra lateral forces exerted on its compartment by an adjacent compartment of a more viscous component.

3. A device as claimed in claim 2, wherein the flow control regulator comprises a variable aperture that increases in size as more pressure is applied by the compression device and reduces in size when the pressure is removed to provide a dynamic restriction.

4. A device as claimed in claim 1, wherein the apertures into the manifold are each in the form of a biased opening.

5. A device as claimed in claim 4, wherein the biased opening is a resilient orifice having an aperture portion comprising a ring of resilient elements and a body portion comprising a ring of material that a base of the resilient elements extend from.

6. A device as claimed in claim 1, wherein the flow control regulator also acts as a valve.

7. A device as claimed in claim 1, wherein the flow control regulator dispensing device comprises a static flow restricting member that has been inserted into the chamber of the less viscous component downstream of the aperture into the manifold section.

8. A device as claimed in claim 7, wherein the static flow restricting member comprises a part ring shaped element.

9. A device as claimed in claim 1, wherein the flow restricting member is sized to provide a restriction that compensates for volumetric differences in the intended volume mixing ratio.

10. A device as claimed in claim 1, wherein the collapsible bag compartments are provided by a plurality of capsules housed within the elongate sleeve, the compartments arranged side by side as separate capsules.

11. A method of assembling a dispensing device as claimed in claim 1, wherein the manifold section is made to a standard design and the flow of a less viscous component through its chamber is adjusted through the addition of a flow control regulator to the manifold section to achieve a better volume mixing ratio at the device outlet.

12. A method as claimed in claim 11, wherein the flow control regulator is selected from the group of an aperture member provided at the entry of the chamber, a flow restricting member provided in the chamber between the aperture and the device outlet, or a plate or cover extending across the chamber that comprises a restrictive opening.

13. A device as claimed in claim 1, wherein the apertures into the manifold are each in the form of a biased opening.

14. A device as claimed in claim 13, wherein the biased opening is a resilient orifice having an aperture portion comprising a ring of resilient elements and a body portion comprising a ring of material that a base of the resilient elements extend from.

* * * * *